US005865881A

United States Patent [19]

Mori et al.

[11] Patent Number: 5,865,881

[45] Date of Patent: Feb. 2, 1999

[54] ELECTROLESS PLATING BATH OF IRIDIUM

[75] Inventors: Hiroaki Mori, Toyonaka; Shoji Maezawa, Kawasaki; Keisuke Oguro, Ikeda-Shi; Eiichi Torikai, Yao, all of Japan

[73] Assignees: Research Institute of Innovative Technology; Agency of Industrial Science and Technology

[21] Appl. No.: 851,727

[22] Filed: May 6, 1997

Related U.S. Application Data

[63] Continuation of Ser. No. 564,785, Nov. 29, 1995, abandoned.

[30] Foreign Application Priority Data

Dec. 1, 1994 [JP] Japan ..... 6-298227

[51] Int. Cl.[6] ..... C23C 18/54

[52] U.S. Cl. ..... 106/1.28; 427/306

[58] Field of Search ..... 106/1.28; 427/436

[56] References Cited

FOREIGN PATENT DOCUMENTS

| | | |
|---|---|---|
| 391974 | 8/1985 | France . |
| 3928434 A1 | 2/1991 | Germany . |
| 58-193381 | 11/1983 | Japan . |
| 2-20709 | 8/1985 | Japan . |
| 60-128780 | 8/1985 | Japan . |
| 60-162780 | 8/1985 | Japan . |

*Primary Examiner*—Kathryn L. Gorgos
*Assistant Examiner*—Kishor Mayekar
*Attorney, Agent, or Firm*—Armstrong,Westerman, Hattori,McLeland & Naughton

[57] ABSTRACT

The present invention relates to a plating bath of the hydrazine type for electroless plating on the surface of a plated substance with iridium. The first plating bath is an electroless plating bath of iridium which contains a hydrazine complex of iridium and has pH of 1–7. The second plating bath is an electroless plating bath of iridium which contains hydrazine hydrate and/or hydrazinium salt, and iridium halide and/or halogenoiridate in the molar ratio of 1–1.0 and has pH of lower than 3. The plating bath of this invention is used, for example, for producing of a junction of a cation exchange membrane and iridium, which is used for a water electrolytic cell of the macromolecule solid electrolyte type.

6 Claims, 2 Drawing Sheets

Fig.1(A)
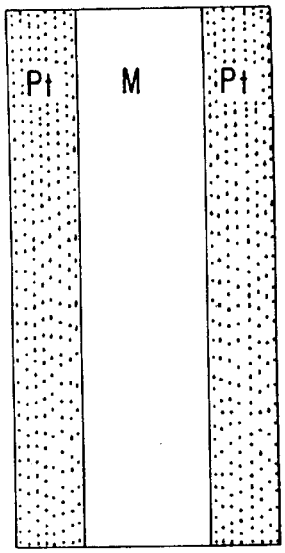
Pt/M/Pt
Fig.1(B)
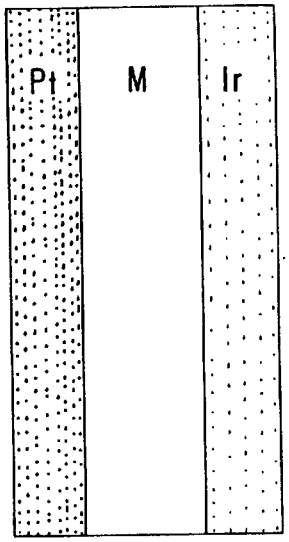
Pt/M/Ir
Fig.1(C)
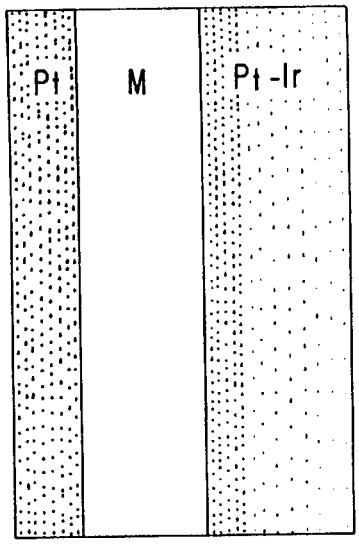
Pt/M/Pt-Ir
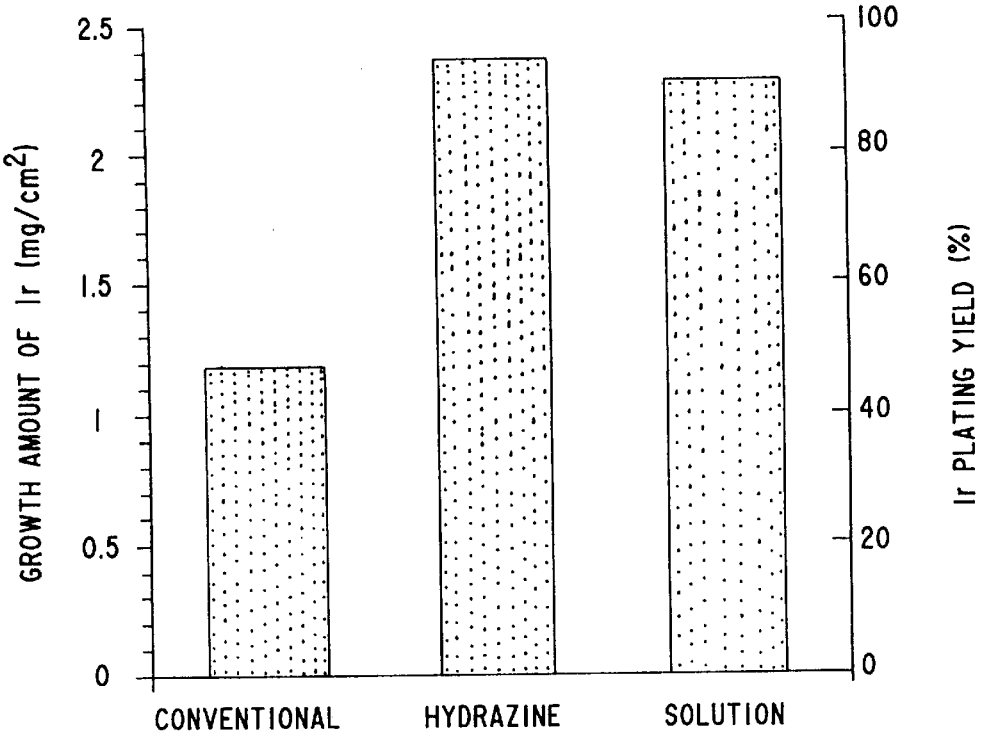
Fig.2

ELECTROLESS PLATING BATH OF IRIDIUM

This application is a continuation of application Ser. No. 08/564,785 filed Nov. 29, 1995, now abandoned.

BACKGROUND OF THE INVENTION

The present invention relates to a plating bath of the hydrazine type for electroless plating with iridium on the surface of a plated substance. This plating bath can be used, for example, not only for producing a junction of a cation exchange membrane and iridium, which is used for a water electrolytic cell of the macromolecule solid electrolyte type, but also for electroless plating of general-purpose metals such as Cu, Fe, and Ni, valve metals such as Ti, Ta, and Nb, products made of macromolecules, glass, ceramics, etc.

Polyelectrolyte water electrolytic process is known as one of water electrolytic processes used for producing hydrogen and oxygen. This is an electrolytic process using perfluorocarbonsulfonic acid membrane as solid electrolyte and supplying pure water to an anode chamber.

Platinum or a carbon membrane supporting platinum is used for the cathode and a cation exchange membrane joined with platinum and iridium by electroless plating (Japanese Patent Publication No.2-20709), or a cation exchange membrane joined with a membrane supporting mixed oxide of iridium and ruthenium by hot press method (Japanese Patent Laid-open Publication No.52-78788) is used for anode as a cation exchange membrane and an electrode incorporated into this electrolytic cell.

A substance having low overvoltage is used as metal or metal oxide suited for a catalytic electrode. Namely, a platinum electrode is used for hydrogen side and a iridium electrode is used for oxygen side.

A process for producing Pt/M/Pt and Pt/M/Pt-Ir (M is a cation exchange membrane) using electroless plating process is described in Japanese Patent Publication No.2-20709. The plating bath used for this process contains iridium halide and hydrazine, or iridium halide, hydrazine, and hydroxylamine and the pH is 3–10.

When plating is performed by use of this conventional bath liquid, iridium is deposited on platinum layer certainly. However, this process had a defect that the utilization of iridium in the bath liquid is lower than 50% and that the adhesion of deposited iridium is not good.

SUMMARY OF THE INVENTION

An improvement of an electroless plating bath of iridium suited for producing a junction of a cation exchange membrane and iridium is attempted in view of the above-mentioned point in the present invention. The object of this invention provides an electroless plating bath of iridium which can attain stabilization of the bath liquid, the improvement of the utilization of iridium, and the improvement of the adhesion of deposited iridium.

The first aspect of this invention is an electroless plating bath of iridium which comprises a hydrazine complex of iridium and has pH of 1–7.

The pH of the first plating bath is 1–7, preferably 1–3, more preferably 2–3, most preferably 2.4–2.8. The pH is controlled by adding a pH adjustor selected from a group consisting of $N_2H_4.H_2O$, a hydrazinium salt, alkali hydroxide, and a mixture thereof. The hydrazinium salt is $N_2H_5Cl$, $N_2H_6Cl_2$, or a mixture thereof.

The hydrazinium complex of iridium is $H[Ir(N_2H_5)Cl_5]$, $K[Ir(N_2H_5)Cl_5]$, or a mixture of them.

The temperature of the first plating bath is about 50°–100° C., preferably 60°–90° C.

The concentration of iridium is 0.5 mM–5 mM, preferably 2 mM–3 mM.

The second aspect of this invention is an electroless plating bath of iridium which comprises hydrazine hydrate and/or hydrazinium salt, and iridium halide and/or halogenoiridate in the molar ratio of 1–10 and has pH of lower than 3.

The hydrazine hydrate and/or hydrazinium salt is $N_2H_4.H_2O$, $N_2H_4.HCl$, $N_2H_4.H_2SO_4$, or a mixture thereof.

The iridium halide and/or halogenoiridate is $H_2IrCl_6.6H_2O$, $Na_2IrCl_6$, $K_2IrCl_6$, $K_3IrCl_6$, $IrCl_3$, $IrCl_4.H_2O$, or a mixture thereof.

The molar ratio of hydrazine hydrate and/or hydrazinium salt to iridium halide and/or halogenoiridate is 1–10 (namely former/latter=1–10/1), preferably 1.3–2.

The temperature of the second plating bath is about 50°–100° C., preferably 60°–90° C.

The concentration of iridium in the second plating bath is 0.5 mM–5 mM, preferably 2 mM–3 mM.

The pH of the second plating bath is lower than 3, preferably 1–3, more preferably 2.4–2.8. The pH is controlled by adding a pH adjustor selected from a group consisting of $N_2H_4.H_2O$, a hydrazinium salt, alkali hydroxide, and a mixture thereof. The hydrazinium salt is $N_2H_5Cl$, $N_2H_6Cl_2$, or a mixture thereof.

The plating bath according to the present invention is preferably used for producing a junction for electrolysis by electroless plating with iridium. For example, the junction for electrolysis is produced by roughening the surface of an ion exchange membrane, making the membrane adsorb the solution of the metal salt, and then performing single-sided or double-sided plating on a platinum layer with iridium using the plating bath of this invention.

The following effects are exhibited by using the plating bath of this invention.

1) The effective electroless plating of iridium is possible by autocatalytic reaction.

2) The stabilization and prolonging life of the plating bath of iridium for producing the junction of the cation exchange membrane and iridium, which is used for the solid polyelectrolyte water electrolytic process, are permitted, a working process of production can be shortened, and a process control is simplified. As a result, a decrease in cost for producing the junction can be achieved.

3) A process by which adhesive and high-purity iridium can be plated a desired thickness.

BRIEF DESCRIPTION OF THE DRAWINGS

FIGS. 1(A), (B) and (C) are sectional views showing electrolytic junctions.

FIG. 2 is a graph showing plating yields.

DESCRIPTION OF THE PREFERRED EMBODIMENTS

Figure 3:
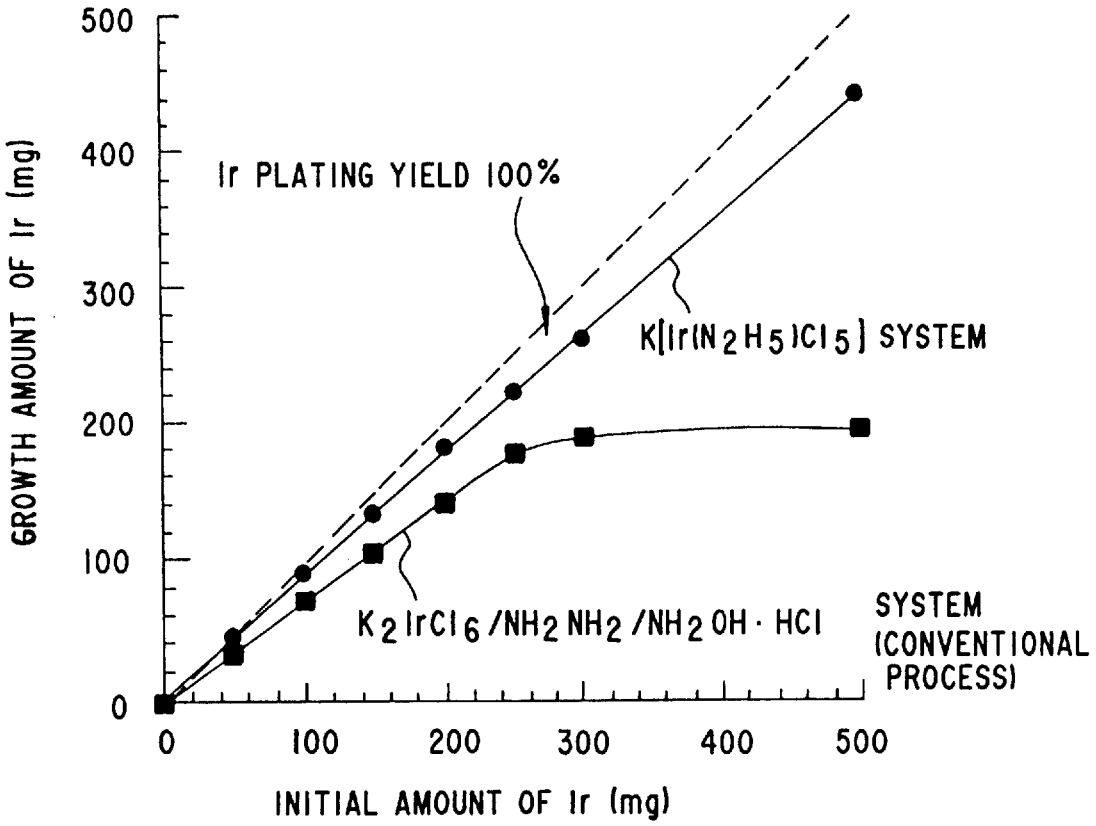
FIG. 3 is a graph showing autocatalytic activities of iridium.

The inventors found that synthesizing hydrazine complexes $H[Ir(N_2H_5)Cl_5]$ and $K[Ir(N_2H_5)Cl_5]$, collecting the crystals, and then immersing an ion exchange membrane joining platinum catalytic layer in the aqueous solution of the crystals, the degree of conversion of plating deposition improves to over 85% compared to 50% by the conventional process. Continuing to analyze this reaction, the inventors found that supplying the above-mentioned complexes and immersing the membrane while controlling the bath liquid so as to keep pH 1–7 during reduction, the plating bath can be used continuously more than 10 turns and that an iridium layer with desired coating thickness can be obtained.

Namely, the first bath liquid of this invention is an electroless plating bath of iridium which comprises the hydrazine complexes of iridium and has pH of 1–7.

This first bath liquid also makes possible to join iridium singly with a cation exchange membrane. In this case, iridium cation or cationic colloid is chemically adsorbed on the cation exchange membrane, iridium cation is reduced with an aqueous solution of a reductant such as borohydride, alkylborane, hydrazine salt, and dithionite to form an iridium catalytic layer, and then the iridium layer can be grown using the bath of this invention.

Provided that in the case of the aim at water electrolysis, a junction obtained by joining the ion exchange membrane with iridium directly does not have satisfactory corrosion resistance against a sulfonic acid membrane and satisfactory catalytic ability for recombination of diffusing gases ($O_2$ in $H_2$, $H_2$ in $O_2$) in the membrane and the purity of the gases is low.

Namely, the corrosion resistance (resistance to dissolution in the membrane) of metals (namely, Pt and Ir) in contact with the sulfonic acid membrane is expressed by relationship Pt>Ir, and the catalytic ability for recombination of the diffusing gases ($O_2$ in , $H_2$, $H_2$ in $O_2$) in the membrane from the junction electrode is also expressed by relationship Pt>Ir.

The kinds of junctions are shown in FIGS. 1(A), (B), and (C).

(A) is a junction which consists of Pt/M/Pt and is excellent in corrosion resistance against the sulfonic acid membrane and in purity of the formed gases, but it has a defect that overvoltage to the oxygen evolution is high.

(B) is a junction in which the sulfonic acid membrane is directly plated with iridium. In this case, the junction is effective for lowering oxygen overvoltage, but it has a defect that the corrosion resistance is low and that the purity of formed oxygen gas is also low.

Compared with them, a junction of Pt/M/Pt-Ir type shown in (C) can obtain excellent ability in all respects of corrosion resistance, purity of formed gases, and oxygen overvoltage.

The pH of electroless plating bath of iridium is preferably 7–9 in the known process. It had been thought that platinum acts as a catalyst under this condition, and that incipient reaction and reaction proceed on the platinum surface but the reaction stops when platinum is covered.

The inventors reexamined reduction which had been thought that iridium has no autocatalytic ability to hydrazine in the conventional electroless plating of iridium, found that inactivation of the Ir surface occurs when the surface is covered with a hydrated iridium oxide layer and that this is attributed to $NH_3$ formed by side reaction of hydrazine salt added excessively, and completed this invention.

The complex used for the plating bath of this invention is preferably $H[Ir(N_2H_5)Cl_5]$, $K[Ir(N_2H_5)Cl_5]$, or a mixture thereof. $K[Ir(N_2H_5)Cl_5]$ can be obtained as high-purity crystals. An initial make-up of electrolytic bath liquid can be also prepared using an intact reaction mixture liquid after complexing without collecting $H[Ir(N_2H_5)Cl_5]$ as crystals. In this case, the inclusion of a by-product salt has some influences, and the utilization of iridium slightly falls, but the fall is within 5%, and there is hardly trouble when the complex is used in a batch type bath.

The control of bath liquid composition can be performed by adjusting pH, Ir concentration, temperature, etc., and the supply can be performed by use of an aqueous solution of hydrazine complex of iridium, hydrazinium salt, $N_2H_4.H_2O$, KOH, NaOH, etc.

The pH is 1–7, preferably 1–3, more preferably 2–3, most preferably 2.4–2.8. When the pH exceeds 7, the Ir surface is subject to inactivation. Since the rate of reduction falls remarkably when the pH is lower than 1, the plating bath becomes unpractical.

The temperature of the bath liquid is about 50°–100° C., preferably 60°–90° C. The growth rate of plating is slow below 50° C., and the evaporation loss of the bath liquid is much above 100° C., which is undesirable for operation.

The concentration of iridium is 0.5 mM–5 mM, preferably 2 mM–3 mM.

A continuous bath liquid can be also used controlling the concentration of iridium. The plating bath with the above-mentioned concentration of iridium is used for the initial make-up of electrolytic bath liquid in the case of the batch type bath. It is preferable to supply $N_2H_4.H_2O$ or hydrazinium salt in order to control pH lowered with the progress of plating. A pH adjustor selected from a group consisting of $N_2H_4.H_2O$, hydrazinium salt, alkali hydroxide, and a mixture thereof can be used for the control of pH. $N_2H_5Cl$, $N_2H_6Cl_2$, etc. are exemplified as the hydrazinium salt.

Iridium acts as an autocatalyst only under the above-mentioned plating condition. Accordingly, it is possible to perform thick plating of iridium with metallic gloss on the iridium surface continuously. This makes the plating bath of this invention particularly preferable as a bath liquid for joining iridium on the membrane surface of a macromolecular membrane such as an ion exchange membrane. Such junction is used for water electrolysis, halogenoacid electrolysis, halide electrolysis as a solid polyelectrolyte electrolytic process.

Industrial materials such as electronic parts or electrode materials of metals, e.g., copper, nickel, iron, alloy thereof, titanium, tantalum, etc. are given as objects to which the plating bath of this invention can be applied other than the above-mentioned objects. The plating bath can be also applied to materials which can undergo ordinary electroless plating such as synthetic resin, e.g., ABS resin, polyamide resin, polycarbonate resin, etc., glass, ceramics, etc.

It is preferable to perform surface active treatment of the plated substance in advance.

In the case of metal, after cleaning the surface of the metal, the metal is immersed in a solution of a salt such as palladium, platinum, rhodium, ruthenium, gold, silver, etc. If necessary, the metal is activated by immersion reduction treatment in a solution of borohydride, etc. continuously, and then the metal is immersed in the plating bath of this invention.

In the case of macromolecular materials, glass, and ceramics, after ordinary surface hydrophiling, sensitization treatment, and the same active treatment as that in the case of the above-mentioned metal, the pretreated substance is also immersed in the plating bath of this invention.

It is preferable that the junction for solid polyelectrolyte water electrolysis consists of Pt/M/Pt-Ir for the above-mentioned reason. First, for example, the Pt/M/Pt junction is prepared by the adsorption-reduction process according to the process described in Japanese Patent Publication No.2-20709 to obtain this junction. Namely, the surface of the ion exchange membrane is roughened, the solution of the metal salt (for example, the salt of platinum, palladium, rhodium, iridium, ruthenium, etc.) was adsorbed by the membrane. Subsequently, if necessary, the membrane is reduced by a sodium borohydride solution, a hydrazine solution, etc. to form the first layer of about 0.1–1 $\mu$m, and then single-sided or double-sided plating is performed on the platinum layer with iridium using the plating bath of this invention. Iridium is an essential catalyst to lower oxygen overvoltage at the anode, but it is not particularly significant to join iridium with the cathode. Joining iridium with the cathode is performed for the purpose of labor-saving, automating of plating operation, and avoiding pollution in the membrane on plating. If single-sided plating is desired, plating can be performed putting two membranes upon each other or covering the other side with resist.

The plating bath of this invention does not need hydroxylamine salt, which has been needed in order to stabilize the bath liquid in the above-mentioned conventional process. Filtering off fallen catalytic metal powder in the bath liquid carefully and circulating the bath liquid as performed in general electroless plating, the plating bath can be used for a long time without autodecomposition.

In addition, the inventors found that the following conditions are important. 1) A supply of necessary and sufficient amount of hydrazine to inhibit side reaction of excess $N_2H_4$, 2) Prevention of inactivation of the Ir surface by keeping the pH lower than 3. To promote the point 1) effectively, the inventors prepared an aqueous solution containing hydrazine hydrate and/or hydrazinium salt, and iridium halide and/or halogenoiridate in the proportion approximate to the component ratio of the hydrazine complex of iridium and examined the solution. As a result, it was found that it is preferable to keep the pH lower than 3 in order to reduce the influence of the by-product $NH_3$ and to adjust the molar ratio of hydrazine/iridium 1–10 to satisfy the above-mentioned two conditions.

Namely, the second bath liquid of this invention is an electroless plating bath of iridium which comprises hydrazine hydrate and/or hydrazinium salt, and iridium halide and/or halogenoiridate in the molar ratio of 1–10 and has pH of lower than 3.

$N_2H_4.H_2O$, $N_2H_4.HCl$, $N_2H_4.H_2SO_4$, etc. are exemplified as hydrazine hydrate and/or hydrazinium salt used for the second plating bath. These are used singly or in combination.

$H_2IrCl_6.6H_2O$, $Na_2IrCl_6$, $K_2IrCl_6$, $K_3IrCl_6$, $IrCl_3$, $IrCl_4.H_2O$, etc. are exemplified as iridium halide and/or halogenoiridate. These are used singly or in combination.

The molar ratio of hydrazine hydrate and/or hydrazinium salt to iridium halide and/or halogenoiridate is 1–10 (namely, former/latter=1–10/1), preferably 1.3–2. When this molar ratio is less than 1, a reducing agent is insufficient and an excess of iridium halide and/or halogenoiridate remains, which results in a lowering of plating yield. It is preferable to keep the upper limit of this molar ratio about 10 mainly in terms of economy.

The concentration of iridium in the bath liquid is 0.5 mM–5 mM, preferably 2 mM–3 mM. The liquid is used continuously controlling this concentration, or the plating bath with the above-mentioned concentration of iridium is used for the initial make-up of electrolytic bath liquid in the case of the batch type bath.

The control of the bath liquid is performed adjusting pH, Ir concentration, temperature, and the supply is performed by use of the above-mentioned iridium compound, hydrazinium salt, and alkali hydroxide.

The pH of the second plating bath is kept lower than 3, preferably 1–3, more preferably 2.4–2.8. When this pH is higher than 3, iridium tends to inactivate.

It was found that the utilization of Ir is remarkably improved compared with the conventional process as shown in FIG. 2 as a result of the batch test. In addition, it was found that iridium acts as an autocatalyst and that the coating thickness increases as shown in FIG. 3 when the pH is 2.4–2.8.

Other constitutions, plating process, etc. of the second plating bath are the same as those of the first plating bath.

EXAMPLES

The present invention is described in detail by giving examples as follows.

Synthesis of iridium-hydrazine complexes

Iridium-hydrazine complexes were synthesized according to the method in Gmelin Handbuch der Anorganishen Chemie Ir. (1978), s.188, (Berichte der Deutschen Chemischen Gesellshaft, 56, 2067 (1923) cited there)).

Synthesis 1 (Synthesis of $H[Ir(N_2H_5)Cl_5]$)

Two hundred milliliter of 10% $N_2H_4.HCl$ was added to 15 g of $K_2[IrCl_6]$ and the mixed liquid was heated on a water bath. After the evolution of gas ceased, the reaction was stopped. A pinkish brown solution was obtained. Concentrating the solution under reduced pressure, the crystals were collected, and 0.8 g of primary crystals were obtained. The purity of the composition $H[Ir(N_2H_5)Cl_5]$ was not high.

Synthesis 2 (Synthesis of $K[Ir(N_2H_5)Cl_5]$)

$[Pt(NH_3)_4]Cl_2$ was added to the pinkish brown solution obtained by synthesis 1 to precipitate $Pt(NH_3)_4$ $[Ir(N_2H_5)Cl_5]_2$. After this precipitation was taken out, $K_2[PtCl_4]$ was added to the aqueous solution of this precipitation to double-decompose $Pt(NH_3)_4$ $[Ir(N_2H_5)Cl_5]_2$. Removing the precipitation of the Pt salt, the reaction liquid was concentrated under reduced pressure to give crystals of $K[Ir(N_2H_5)Cl_5]$.

Synthesis 3 (Synthesis of $K[Ir(N_2H_5)Cl_5]$)

Three grams of $K_2[IrCl_6]$ was dissolved in 300 ml of boiling water and 140 ml of 10% $N_2H_4.HCl$ was slowly added. After the addition, the evolution of gas soon ceased and a reddish brown solution was obtained. This solution was concentrated to 10 ml, cooled to room temperature, and then a concentrated aqueous solution containing 2.3 g of $[Pt(NH_3)_4]Cl_2$ was added thereto to precipitate $[Pt(NH_3)_4]$ $[Ir(N_2H_5)Cl_5]_2$ immediately. This precipitation was filtered off and washed thoroughly with 3N hydrochloric acid. This precipitation was added to a concentrated aqueous solution containing 2.6 g of $K_2[PtCl_4]$. Stirring was continued for 2 hours at room temperature, $K[Ir(N_2H_5)Cl_5]$ was extracted in the solution, and an insoluble matter was filtered out. Finally, the solution was evaporated to dryness to give crystals of $K[Ir(N_2H_5)Cl_5]$.

Example 1

The surface of a perfluorocarbonsulfonic acid cation exchange membrane "Nafion 117" (du Pont Co.) was roughened by sand blast, followed by boiling the membrane with 10% hydrochloric acid, and washing it with hot water.

This pretreated membrane was set in an acrylic plating cell, immersed in a 1 mg/ml aqueous tetraammineplatinum solution, and allowed to stand for 3 hours.

After water washing, the membrane was immersed in a 0.05% aqueous $NaBH_4$ solution at room temperature to 60° C. for 4 hours, and an about 1 mg/cm$^2$ (membrane area) of platinum layer was deposited on the surface of the reaction membrane by reduction.

This membrane is termed Pt junction membrane hereinafter.

An iridium plating bath having the following composition was prepared using $K[Ir(N_2H_5)Cl_5]$.

| | |
|---|---|
| $K[Ir(N_2H_5)Cl_5]$ | 1.0 g (Ir: 0.433 g) |
| water | 750 ml |
| pH (initial) | 2.8 |

The iridium plating bath having the above-mentioned composition was circulated in the plating cell while the bath temperature was kept at 70° C., and 1/10N $N_2H_4.H_2O$ was added to the bath liquid with a micropump connected to a pH controller to keep the pH 2.2–2.8.

After 4 hours, 4.08 mg/cm$^2$ (membrane area) of an iridium layer was obtained. The plating yield was 94.2%.

This result is shown in FIG. 2.

Example 2

An iridium plating bath having the following composition was prepared using $H[Ir(N_2H_5)Cl_5]$.

| | |
|---|---|
| $H[Ir(N_2H_5)Cl_5]$ | 1.0 g (Ir: 0.401 g) |
| water | 750 ml |
| pH (initial) | 2.8 (adjusted with $N_2H_4.H_2O$) |

The iridium plating bath having the above-mentioned composition was circulated in the plating cell while the bath temperature was kept at 70° C., and 1/10N $N_2H_4.H_2O$ was added to the bath liquid with the micropump connected to the pH controller to keep the pH 2.3–2.8.

After 4 hours, 3.75 mg/cm$^2$ (membrane area) of an iridium layer was obtained. The plating yield was 93.5%.

Example 3

The same iridium plating bath as that of Example 1 was prepared.

The above-mentioned iridium plating bath was circulated in the plating cell while the bath temperature was kept at 70° C., and 1/10N $N_2H_5Cl$ was added to the bath liquid with the micropump connected to the pH controller to keep the pH about 2.8.

After 4 hours, 4.33 mg/cm$^2$ (membrane area) of an iridium layer was obtained. The plating yield was 99.9%.

Example 4

The same iridium plating bath as that of Example 1 was prepared.

The above-mentioned iridium plating bath was circulated in the plating cell while the bath temperature was kept at 70° C., and 1/10N $N_2H_4.H_2O$ was added to the bath liquid with the micropump connected to the pH controller to keep the pH about 2.8.

After 4 hours, 4.32 mg/cm (membrane area) of an iridium layer was obtained. Then the plating yield was 99.9%.

Example 5

The same iridium plating bath as that of Example 1 was prepared.

The above-mentioned iridium plating bath was circulated in the plating cell while the bath temperature was kept at 70° C., and 1/10N NaOH was added to the bath liquid with the micropump connected to the pH controller to keep the pH about 2.8.

After 4 hours, 4.05 mg/cm$^2$ (membrane area) of an iridium layer was obtained. The plating yield was 94.0%.

Example 6

The iridium plating bath was used continuously in this example.

The iridium plating bath was prepared in the same manner as that of Example 1, the iridium plating bath was circulated in the plating cell, and an iridium layer was grown on the Pt junction membrane.

Secondly, $K[Ir(N_2H_5)Cl_5]$ was added to supply consumed iridium, the concentration of $K[Ir(N_2H_5)Cl_5]$ was kept 2–3 mM, and the iridium layer was grown on the Pt junction membrane prepared by the alternate process.

This operation was repeated 10 times and the iridium plating bath was used continuously.

In addition, the above-mentioned iridium plating bath was circulated in the plating cell while the bath temperature was kept at 70° C., and 1/10N $N_2H_5Cl$ was added to the bath liquid with the micropump connected to the pH controller to keep the pH 2.0–3.0. The 3 mg/cm$^2$ (membrane area) of iridium layers were formed on each Pt junction membrane.

The plating yields of this continuous layer plating were kept over 90%.

This result is shown in Table 1.

TABLE 1

(Plating result by continuous use of iridium bath liquid)

| Number of growth | Initial amount of Ir (g) | Growth amount of Ir (mg/cm$^2$) | Ir plating yield (%) |
|---|---|---|---|
| 1 | 0.435 | 4.07 | 93.9 |
| 2 | 0.416 | 3.97 | 93.3 |
| 3 | 0.423 | 4.05 | 93.6 |
| 4 | 0.431 | 4.02 | 92.4 |
| 5 | 0.436 | 3.90 | 92.0 |
| 6 | 0.440 | 3.93 | 92.2 |
| 7 | 0.445 | 3.85 | 91.0 |
| 8 | 0.441 | 3.87 | 90.5 |
| 9 | 0.450 | 3.95 | 90.6 |
| 10 | 0.452 | 3.91 | 90.3 |

Example 7

The Pt junction membrane was formed on the cation exchange membrane in the same manner as that of Example 1. The iridium plating bath having the following composition was prepared using $K_2IrCl_6$.

| | |
|---|---|
| $K_2IrCl_6$ | 1.1 g (Ir: 0.435 g) |
| $N_2H_4.HCl$ | 0.31 g |
| water | 750 ml |
| pH (initial) | 2.8 |

The iridium plating bath having the above-mentioned composition was circulated in the plating cell while the bath temperature was kept at 70° C., and 1/10N $N_2H_5Cl$ was added to the bath liquid with the micropump connected to the pH controller to keep pH 2.3–2.8.

After 4 hours, 3.85 mg/cm$^2$ (membrane area) of an iridium layer was obtained. The plating yield was 88.6%.

This result is shown in FIG. 2.

Example 8

The iridium plating bath having the following composition was prepared using $K_2IrCl_6$.

| | |
|---|---|
| $K_2IrCl_6$ | 1.1 g (Ir: 0.435 g) |
| $N_2H_4.HCl$ | 0.31 g |
| water | 750 ml |
| pH (initial) | 2.8 |

The iridium plating bath having the above-mentioned composition was circulated in the plating cell while the bath temperature was kept at 70° C., and 1/10N $N_2H_5Cl$ was added to the bath liquid with the micropump connected to the pH controller to keep the pH about 2.8.

After 4 hours, 4.35 mg/cm$^2$ (membrane area) of an iridium layer was obtained. The plating yield was 99.9%.

Example 9

The iridium plating bath having the following composition was prepared using $H_2IrCl_6$.

| | |
|---|---|
| $K_2IrCl_6$ | 0.91 g (Ir: 0.430 g) |
| $N_2H_4.HCl$ | 0.31 g |
| water | 750 ml |
| pH (initial) | 2.8 (adjusted with 1/10 N NaOH) |

The iridium plating bath having the above-mentioned composition was circulated in the plating cell while the bath temperature was kept at 70° C., and 1/10N NaOH was added to the bath liquid with the micropump connected to the pH controller to keep the pH about 2.4–2.8.

After 4 hours, 3.79 mg/cm (membrane area) of an iridium layer was obtained. The plating yield was 88.1%.

Example 10

The iridium plating bath having the following composition was prepared using $Na_2IrCl_6$.

| | |
|---|---|
| $Na_2IrCl_6$ | 1.0 g (Ir: 0.430 g) |
| $N_2H_4.HCl$ | 0.28 g |
| water | 750 ml |
| pH (initial) | 2.8 (adjusted with 1/10N HCl) |

The iridium plating bath having the above-mentioned composition was circulated in the plating cell while the bath temperature was kept at 70° C., and 1/10N $N_2H_4.H_2O$ was added to the bath liquid with the micropump connected to the pH controller to keep the pH 2.4–2.8.

After 4 hours, 3.83 mg/cm$^2$ (membrane area) of an iridium layer was obtained. The plating yield was 89.1%.

Example 11

The iridium plating bath having the following composition was prepared using $IrCl_3$.

First, 6.7 g of iridium (III) chloride was dissolved in 500 ml of water. On the other hand, a solution in which 3.1 g of hydrazinium chloride was dissolved in 300 ml of water was prepared. The aqueous hydrazinium solution and 2 ml of concentrated hydrochloric acid were added to the aqueous iridium chloride solution with stirring, the temperature was raised, and kept at 90° C. Then, the aqueous iridium complex solution was concentrated to about 50 ml, cooled to room temperature, and then the volume of the solution was adjusted to 100 ml. Ten milliliter of the solution was collected, this solution was diluted to 750 ml with water, and 1/10N NaOH was added thereto to adjust the pH 2.8. This solution was used as an iridium plating bath.

The iridium plating bath having the above-mentioned composition was circulated in the plating cell while the bath temperature was kept at 70° C., and 1/10N $N_2H_5Cl$ was added to the bath liquid with the micropump connected to the pH controller to keep the pH 2.2–2.7.

After 4 hours, 3.79 mg/cm$^2$ (membrane area) of an iridium layer was obtained. The plating yield was 87.3%.

Example 12

The Pt junction membrane was formed on the cation exchange membrane, and the iridium plating bath was prepared in the same manner as that of Example 7.

The above-mentioned iridium plating bath was circulated in the plating cell while the bath temperature was kept at 70° C., and 1/10N $N_2H_4.H_2O$ was added to the bath liquid with the micropump connected to the pH controller to keep the pH near 2.8.

After 4 hours, 4.32 mg/cm$^2$ (membrane area) of an iridium layer was obtained. The plating yield was 99.9%.

Example 13

The same iridium plating bath as that of Example 7 was prepared.

The iridium plating bath having the above-mentioned composition was circulated in the plating cell while the bath temperature was kept at 70° C., and 1/10N NaOH was added to the bath liquid with the micropump connected to the pH controller to keep the pH near 2.8.

After 4 hours, 3.89 mg/cm$^2$ (membrane area) of an iridium layer was obtained. The plating yield was 90.3%.

Example 14

The iridium plating bath was used continuously.

The iridium plating bath was prepared in the same manner as that of Example 7, the iridium plating bath was circulated in the plating cell, and an iridium layer was grown on the Pt junction membrane.

Secondly, $K_2IrCl_6$ was added thereto to supply consumed iridium, the concentration of $K_2IrCl_6$ was kept 2–3 mM, and the iridium layer was grown on the Pt junction membrane prepared by the alternate process.

This operation was repeated 10 times and the iridium plating bath was used continuously.

In addition, the above-mentioned iridium plating bath was circulated in the plating cell while the bath temperature was kept at 70° C., and 1/10N $N_2H_5Cl$ was added to the bath liquid with the micropump connected to the pH controller to keep the pH 2.0–3.0. The 3 mg/cm$^2$ (membrane area) of iridium layers were formed on each Pt junction membrane.

The plating yields of this continuous layer plating were kept over 85%.

TABLE 2

(Plating result by continuous use of iridium bath liquid)

| Number of growth | Initial amount of Ir (g) | Growth amount of Ir (mg/cm$^2$) | Ir plating yield (%) |
|---|---|---|---|
| 1 | 0.433 | 3.88 | 89.5 |
| 2 | 0.426 | 3.79 | 89.0 |
| 3 | 0.433 | 3.86 | 89.2 |
| 4 | 0.435 | 3.88 | 89.1 |
| 5 | 0.424 | 3.77 | 88.8 |
| 6 | 0.426 | 3.79 | 89.0 |
| 7 | 0.423 | 3.74 | 88.3 |
| 8 | 0.428 | 3.77 | 88.1 |
| 9 | 0.436 | 3.83 | 87.8 |
| 10 | 0.433 | 3.77 | 87.1 |

Example 15

The presence of autocatalysis of iridium was confirmed in this example.

The relationship between the initial amount of Ir and the amount of Ir deposited on the Pt junction membrane was examined under the condition of reaction temperature of 70° C. and reaction time of 4 hours about the iridium complex process ($K_2IrCl_6/NH_2NH_2.HCl$ system, pH 2.3–2.8) according to the present invention and the conventional process ($K_2IrCl_6/NH_2NH_2/NH_2OH.HCl$ system, pH 7.0–7.2).

In the case of the iridium complex process, the proportionality holds between the initial amount of Ir and the growth amount of Ir, and the growth rate of Ir to the initial amount of Ir was always over 90%.

On the other hand, in the case of the conventional process, when the initial amount of Ir is less than 250 mg, the proportionality is found between the initial amount of Ir and the growth amount of Ir. However, even if the initial amount of Ir exceeds 250 mg, the growth amount of Ir is constant at about 200 mg.

This result shows that Ir is deposited on the Pt surface and that the Ir layer becomes thick, namely, that the Ir layer grows by the autocatalytic ability of Ir in the case of using the iridium complex.

However, the iridium complex is inactivated by by-product $NH_3$ in the case of the conventional process. This shows that Ir grows while the Pt surface is exposed but the reaction stops when Ir covers the Pt surface.

These results are shown in FIG. 3.

Comparative example 1

The iridium plating bath having the following composition was prepared using potassium chloroiridate (IV).

| | |
|---|---|
| $K_2IrCl_6$ | 0.626 g (Ir: 0.249 g) |
| 5% $NH_2OH.HCl$ | 20 ml |
| 20% $N_2H_4.H_2O$ | 8 ml |
| water | 500 ml |
| pH (initial) | 7.2 |

The Pt junction membrane was immersed in the plating bath having the above-mentioned composition, and the bath temperature was kept at 70° C. for 4 hours. Meanwhile, without adjusting the pH, the pH rises to 7.2–9.1. After 4 hours, 1.19 mg/cm$^2$ of an iridium layer was obtained. The plating yield was 47.8%.

This result is shown in FIG. 2.

Comparative example 2

The iridium plating bath was prepared in the same manner as that of Example 1.

Secondly, 1/10N NaOH was added to the bath liquid to adjust the pH 7.0.

The above-mentioned iridium plating bath was circulated in the Pt junction membrane, and 1/10N NaOH was added to the bath liquid at 70° C. to keep the pH near 5. However, since autodecomposition of the iridium complex proceeded in the course of the growth reaction and the Ir metal was deposited, it was impossible to plate the Pt junction membrane with iridium selectively.

What is claimed is:

1. An aqueous electroless plating bath of iridium which comprises a bath-soluble hydrazine complex of iridium and a pH adjustor selected from the group consisting of $N_2H_4.H_2O$, a hydrazinium salt, alkali hydroxide and a mixture thereof in an amount sufficient to provide a bath pH of 1–3.

2. The plating bath according to claim 1, wherein said pH is 2.4–2.8.

3. The plating bath according to claim 1, wherein said hydrazine complex of iridium is $H[Ir(N_2H_5)Cl_5]$, $K[Ir(N_2H_5)Cl_5]$, or a mixture thereof.

4. The plating bath according to claim 1, wherein said bath has an iridium concentration of 0.5 mM–5 mM.

5. The plating bath according to claim 4, wherein said iridium concentration in the bath liquid is 2 mM–3 mM.

6. The plating bath according to claim 1, wherein said hydrazinium salt is selected from $N_2H_5Cl$, $N_2H_6Cl_2$, or a mixture thereof.

* * * * *